US006729346B2

(12) United States Patent
Führmann

(10) Patent No.: US 6,729,346 B2
(45) Date of Patent: May 4, 2004

(54) PNEUMATIC VALVE

(75) Inventor: Jörg Führmann, Weisendorf (DE)

(73) Assignee: Demag Cranes & Components GmbH, Wetter (DE)

( * ) Notice: Subject to any disclaimer, the term of this patent is extended or adjusted under 35 U.S.C. 154(b) by 0 days.

(21) Appl. No.: 09/918,192

(22) Filed: Jul. 30, 2001

(65) Prior Publication Data

US 2002/0157709 A1 Oct. 31, 2002

(30) Foreign Application Priority Data

Apr. 27, 2001 (DE) ..... 101 23 157

(51) Int. Cl.[7] ..... G05D 7/03
(52) U.S. Cl. ..... 137/501; 251/122
(58) Field of Search ..... 137/501, 625.69; 251/122

(56) References Cited

U.S. PATENT DOCUMENTS

| | | | | |
|---|---|---|---|---|
| 2,495,785 A | | 1/1950 | Stephens | |
| 2,990,847 A | | 7/1961 | Absalom | |
| 3,554,222 A | | 1/1971 | Koyama et al. | |
| 3,770,007 A | * | 11/1973 | Orth et al. | 137/493 |
| 3,773,083 A | * | 11/1973 | Hague et al. | 137/625.69 |
| 3,807,443 A | * | 4/1974 | Jacobs | 137/493 |
| 4,422,470 A | * | 12/1983 | Jackson et al. | 137/484.2 |
| 4,694,852 A | * | 9/1987 | Grant | 137/501 |
| 5,027,919 A | * | 7/1991 | Silva et al. | 251/122 |
| 5,097,863 A | * | 3/1992 | McCann et al. | 137/504 |
| 5,913,328 A | * | 6/1999 | Taube et al. | 137/501 |

FOREIGN PATENT DOCUMENTS

| | | | | |
|---|---|---|---|---|
| DE | 500 790 | * | 6/1930 | 137/505.18 |
| DE | 298 02 606 | | 6/1998 | |
| GB | 809651 | * | 2/1959 | 137/501 |
| WO | WO 97 32136 | | 9/1997 | |

OTHER PUBLICATIONS

Pneumatische Steuerungstechnik, R. Haug, Teubner Verlag, Stuttgart 1991, p. 228.

* cited by examiner

*Primary Examiner*—Stephen M. Hepperle
(74) *Attorney, Agent, or Firm*—Henry M. Feiereisen

(57) ABSTRACT

A pneumatic valve, includes a housing having first and second ports for entry and exit of an operating gas, a main connection line for linking the ports, and a cross bore intersecting the main connection line. A throttle includes a control element which is received in the cross bore and has a control opening with an effective area which progressively decreases from a first end position to a second end position, as the control element moves in a direction toward the second end position, whereby a counterforce is provided to oppose this movement of the control element. Disposed in the main connection line in series with the throttle is a flow orifice, wherein a gas pressure differential upstream and downstream of the flow orifice, as viewed in movement direction of the control element, is utilized to control the effective area of the control opening.

21 Claims, 3 Drawing Sheets

PNEUMATIC VALVE

CROSS-REFERENCES TO RELATED APPLICATIONS

This application claims the priority of German Patent Application Serial No. 101 23 157.1, filed Apr. 27, 2001, the subject matter of which is incorporated herein by reference.

BACKGROUND OF THE INVENTION

The present invention relates, in general, to a pneumatic valve, and more particularly to a pneumatic valve for use in a pneumatic lifting drive for controlling the volume flow of an operating gas under pressure.

Pneumatic lifting drives oftentimes have the problem that the pneumatic drives, connected to a supply source to feed gas under pressure, lift too quickly or lower too slowly, when the load is small, or lift too slowly or lower too quickly, when the load is high. The reason is the compressibility and thus the energy storing capability of the operating gas, e.g. air. In order to realize a substantially even movement velocity of the pneumatic drive despite changing loads, the provision of a pneumatic valve is necessary to maintain a constant pressure-independent volume flow to and from the pneumatic drive.

German utility model DE 298 02 606 A1 describes the use of such a pneumatic valve for controlling the volume flow of operating gas. The pneumatic valve has a gas inlet port, a gas outlet port, and throttle valves disposed between the inlet and outlet ports and activated by a control unit. When incorporated in a lifting drive, the activation of the pneumatic valve is realized in dependence on the load, with a sensor-activation unit disposed in the force flux. This conventional pneumatic valve suffers shortcomings because the pneumatic valve and its throttle valves have to be disposed in the force flux, resulting in a heavy overall structure because the structure must correspond to the mechanical load.

Section 5.4.3 of publication "Pneumatische Steuerungstechnik [*Pneumatic Control Techniques*], R. Haug, Teubner-Verlag, Stuttgart 1991, page 228, proposes to maintain a constant volume flow by means of a differential pressure regulator with gas pressure taps on opposite sides of a throttle valve or orifice. This configuration has the drawback that the volume flow can be controlled only in one direction and that the overall structure is rather complicated.

It would therefore be desirable and advantageous to provide an improved pneumatic valve which obviates prior art shortcomings and is able to maintain a substantially constant, pressure-independent volume flow and which is useful for operation in both flow directions, while yet being reliable in operation and simple in structure.

SUMMARY OF THE INVENTION

According to one aspect of the present invention, a pneumatic valve, in particular for use in a pneumatic lifting drive, for controlling a volume flow of an operating gas supplied under pressure, includes a valve body having a main connection line for linking first and second ports for entry and exit of the operating gas, and a cross bore extending across the valve body and intersecting the main connection line; an adjustable throttle including a control element received in the cross bore for movement between first and second end positions and having a control opening for the operating gas with an effective area which progressively decreases in a direction to the second end position, as the control element moves from the first end position toward the second end position, and a counterforce member opposing a movement of the control element toward the second end position; and a flow orifice disposed in the main connection line, wherein the throttle and the orifice are disposed in series in the main connection line, and wherein, as viewed in movement direction, the control element is acted upon on a side confronting the first end position by gas pressure commensurate with a gas pressure upstream of the orifice, and acted upon on a side confronting the second end position by gas pressure commensurate with a gas pressure downstream of the orifice, for controlling the effective area of the control opening in dependence on a difference between the gas pressures upstream and downstream of the orifice.

Depending on the size of the volume flow, different pressures are encountered in flow direction on opposite sides of the orifice, i.e. a pressure differential exists across the orifice. These gas pressures act on opposite sides of the control element to move the control element until the elastic counterforce effectively realizes that the overall force on the control element is zero. This means that the control element is shifted between both end positions until reaching a position in which the overall force acting on the control element has substantially vanished except for slight negligible friction losses. Depending on the movement direction, the effective area of the control element becomes smaller or greater during displacement. Thus, a closed-loop control circuit is established for the volume flow and is controllable proportional to the square root of the difference of the gas pressures on opposite sides of the orifice.

According to another feature of the present invention, the cross bore is a cylindrical throughbore, and the control element is a control piston made of plastic and having a cylindrical configuration that complements the cylindrical configuration of the throughbore. In this way, the control piston can be displaced in the throughbore substantially free of friction.

According to another feature of the present invention, the control element is shifted by the counterforce member to a position which is commensurate with the first end position, when no gas pressure acts upon the control member. Suitably, the control element reaches this position, when the gas pressure differential is zero and the control opening has a maximum effective area, so that the full lifting force is immediately effective in a lifting drive, when a nominal weight is to be lifted.

The counterforce may be formed by an elastic element, e.g. a helical spring.

In order to realize a soft opening of the throttle, the main connection line may include two parallel ring channels which are connectable to one another by the control opening only. The connection of the ring channels may be implemented by providing the control opening through formation of V-shaped grooves in the outer surface area of the control element. The provision of such grooves results in a particularly soft opening of the throttle. Suitably, each of the V-shaped grooves has side surfaces defining a triangle to simplify manufacture while still maintaining a soft opening of the throttle.

An effective orifice area can be implemented in a simple manner by providing an adjustment cylinder having a conically tapered end portion for projection through the orifice so that the effective orifice area can be adjusted through appropriate positioning of the cylinder.

According to another feature of the present invention, the control element may be connected on the side confronting the first end position by a first auxiliary connection line with a portion of the main connection line, disposed directly upstream of the orifice, and connected on the side confronting the second end position by a second auxiliary connection line with a portion of the main connection line, disposed directly downstream of the orifice. Suitably, a reversing valve may be provided for switching connections of the first and second auxiliary connection lines such that the first auxiliary connection line is connected with the portion of the main connection line, disposed directly downstream of the orifice, and the second auxiliary connection line is connected with the portion of the main connection line, disposed directly upstream of the flow orifice, wherein the one of the first and second ports intended for outgoing operating gas is disconnected by the reversing valve from the gas supply and connected for venting.

BRIEF DESCRIPTION OF THE DRAWING

Other features and advantages of the present invention will be more readily apparent upon reading the following description of preferred exemplified embodiments of the invention with reference to the accompanying drawing, in which.

DETAILED DESCRIPTION OF PREFERRED EMBODIMENTS

Figure 1:
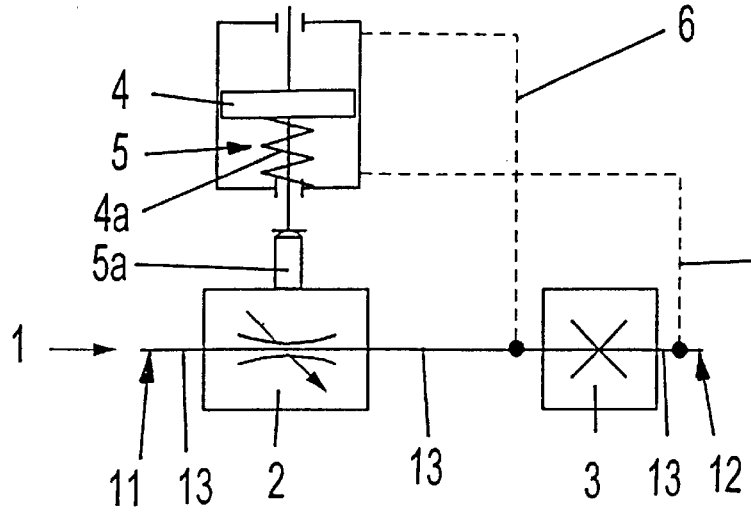
FIG. 1 is a schematic illustration of a basic configuration of a pneumatic valve according to the present invention.

Throughout all the Figures, same or corresponding elements are generally indicated by same reference numerals.

Turning now to the drawing, and in particular to FIG. 1, there is shown a schematic illustration of a basic configuration of a pneumatic valve according to the present invention, for regulating a volume flow 1 of an operating gas fed under pressure from a, not shown, supply source. The volume flow 1 passes through a throttle 2 and a pneumatic orifice 3 which are disposed in series in flow direction of the volume flow 1, as indicated by the arrow. Of course, the throttle 2 and the orifice 3 may be arranged in reverse sequence as well, i.e. the orifice 3 may be disposed upstream of the throttle, as viewed in flow direction. The pneumatic valve further includes a control element 4 which is loaded by an elastic counterforce member 5, e.g. a helical spring 4*a*, and moveable between two end positions. Of course, the provision of a helical spring as elastic counterforce is done by way of example only, as any other suitable elastic member may certainly be used instead as counterforce member 5, so long as the counterforce member 5 is continuously dependent on the position of the control element 4.

As viewed in movement direction, gas is admitted to one side of the control element 4 via an auxiliary connection line 6 at a gas pressure which corresponds to the gas pressure upstream of the orifice 3, and to the other side of the control element 4 via an auxiliary connection line 7 at a gas pressure which corresponds to the gas pressure downstream of the orifice 3. As a consequence, the gas pressure differential across the orifice 3 acts on the control element 4 to move it until the force applied the counterforce member 5 is large enough that the sum of the forces acting on the control element 4 is zero. Reference numeral 5*a* illustrates symbolically a connection between the control element 4 and the throttle 2 to adjust the volume flow 1.

Figure 2:
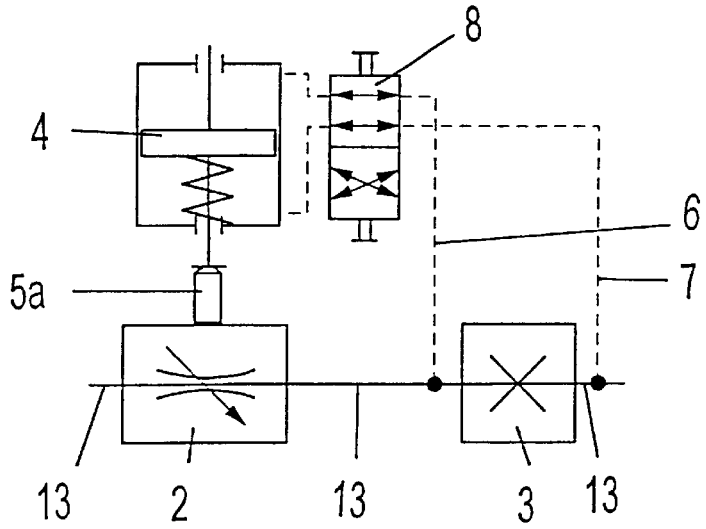
FIG. 2 is a schematic illustration of the pneumatic valve of FIG. 1 with incorporation of a reversing valve.

FIG. 2 shows a schematic illustration of a variation of a pneumatic valve according to the present invention. Parts corresponding with those in FIG. 1 are denoted by identical reference numerals and not explained again. In this embodiment, provision is made for the incorporation of an additional reversing valve 8 by which the auxiliary connection lines 6, 7 are switched the other way to operate the pneumatic valve in reverse flow direction of the volume flow 1.

Figure 3:
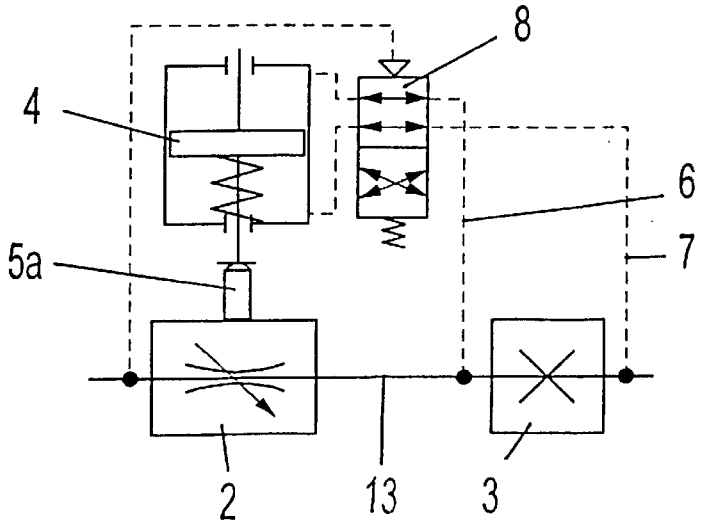
FIG. 3 is a schematic illustration of the pneumatic valve of FIG. 2 with automatic switchover of the reversing valve.

FIG. 3 shows a schematic illustration of another variation of a pneumatic valve according to the present invention. Again, parts corresponding with those in FIG. 1 are denoted by identical reference numerals and not explained again. In this embodiment, provision is made for a further auxiliary connection line 9 which fluidly connects the reversing valve 8 with a, not shown, feed line for the volume flow 1, whereby the feed line can be selectively connected for communication with the gas source for receiving gas under pressure, or for ventilation.

Figure 4:
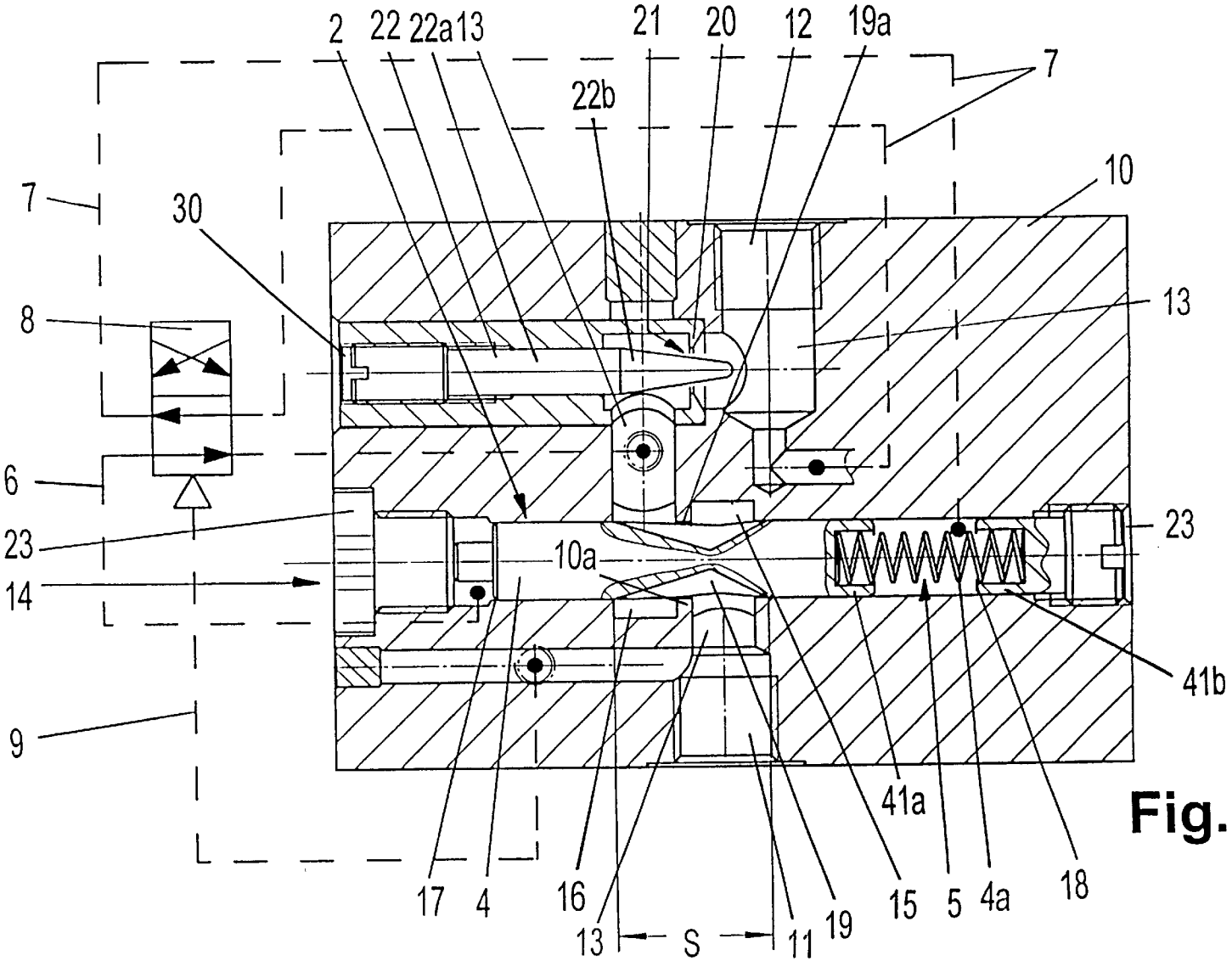
FIG. 4 is a cross sectional view of the pneumatic valve of FIG. 3.

Turning now FIG. 4, there is shown a cross sectional view of the pneumatic valve of FIG. 3. The pneumatic valve includes a valve body 10 of metal, such as aluminum alloy, and is shown in a first operative mode, e.g. lifting of a load, when the pneumatic valve is used for a lifting drive. The valve body 10 includes a first opening 11, which represents in this operative mode an inlet port for the volume flow 1 in the operative mode shown in FIG. 4 Located on the opposite side, the valve body 10 includes a second opening 12 which represents here an outlet port, with both openings 11, 12 connected to one another by a main connection line 13. The opening 11 communicates with a cross bore 14 which extends transversely through the valve body 10 and intersects the main connection line 13 and which is configured as a cylindrical throughbore. Plugs 23 tightly seal off axial ends of the cross bore 14 to the outside. A pair of ring channels 15, 16 is separated by a ridge 10*a* and located in the area of the cross bore 14 for communication with the main connection line 13, with the ring channels 15, 16 arranged in parallel side-by-side relationship and connected to one another via the cross bore 14. A control element 4 in the form of a plastic cylindrical piston is received in the cross bore 14 for displacement in a substantially frictionless manner between two end positions, and seals the main connection line 13 airtight from the outside. At the right hand side of FIG. 4, the control element 4 has U-shaped receptacles 41*a*, 41*b* in confronting spaced-apart disposition to receive the axial ends of the elastic counterforce member 5 in the form of the helical spring 4*a* by which the control element 4 is biased to seek the left end position which is reached at stop point 17, when the helical spring 4*a* is in a fully relaxed state. The other end position, i.e. the right end position, of the control element 4 is defined by a stop 18 which is formed by a plug-distal axial end face of the receptacle 41*b*. In the area of the ring channels 15, 16, the control element 4 has an outer surface area which is formed with longitudinal depressions 19 to form a control opening 19*a* which interacts with the ridge 10*a* of the valve body 10 to define an effective area of the control opening 19*a*. Thence, operating gas is able to flow via the depressions 19 of the control opening 19*a* from the ring channel 15 into the ring channel 16 and from there through an orifice 21 of an orifice member 20 to the second opening 12 for exiting the pneumatic valve.

The orifice member 20 has a stepped interior bore 30 for guiding an adjusting member 22 having a generally cylindrical main body 22*a* and a conically tapered end portion 22*b* which projects through the orifice 21 at formation of a circumscribing annular gap. The effective orifice area can be changed through repositioning the adjusting member 22 in the interior bore 30, e.g. through application of an appropriate, not shown, tool attached from outside against the confronting rear end of the adjusting member 22.

The auxiliary connection line 6 extends from a location upstream of the orifice member 20 and behind the cross bore 14, and is routed across the reversing valve 8 to the left side of the cross bore 14 in the area of the stop point 17, as shown in FIG. 4. The auxiliary connection line 7 extends from behind the orifice member 20 across the reversing valve 8 to the cross bore 14 and terminates on the right side of the cross bore 14 in the area of the stop 18, as shown in FIG. 4. Thus, the control element 4 is connected on the side confronting the first end position (stop point 17) via the auxiliary connection line 6 with a portion of the main connection line 13, which is disposed upstream of the orifice member 20, and is connected on the side confronting the second end position (stop 18) via the auxiliary connection line 7 with a portion of the main connection line 13, which is disposed downstream of the orifice member 20.

When no gas pressure differential exists between gas pressures on opposite sides of the orifice member 20, the counterforce member 5 urges the control element 4 to the left end position, reached at stop point 17. In this position, shown in FIG. 4, the control opening 19*a* has a greatest effective area. As the gas pressure upstream of the orifice 21 increases with respect to the gas pressure downstream of the orifice 21 and thus the pressure differential increases, the control element 4 is shifted in the cross bore 14 to the right toward the right end position (stop 18) in opposition to the spring action applied by the helical spring 4*a*. As the control element 4 moves to the right, the effective area of the control opening 19*a* decreases, thereby reducing the gas pressure in the area upstream of the orifice 21. The control element 4 is thus displaced to the right until the pressure differential on opposite sides of the orifice 21 is zero. The control opening 19*a* is so configured that the effective area progressively decreases linearly as the control element 4 travels from the left end position (stop point 17) in a direction toward the right end position (stop 18). In this way, the effective area of the control opening 19*a* is controlled in dependence on the difference between gas pressures on opposite sides of the orifice 21.

The volume flow 1 is established in a simple manner on the basis of the effective area of the orifice 21, the characteristic curve of the helical spring 4*a* and the effective area of the control opening 19*a* of the control element 4.

The further auxiliary connection line 9 provides a connection between the reversing valve 8 and the, not shown, feed line so as to connect the feed line either for supply of gas under pressure or for venting.

When the reversing valve 8 is switched over to operate the pneumatic valve in a second operative mode, e.g. lowering a load, when the pneumatic valve is used for a lifting drive, the flow direction of operating gas is respectively changed to flow through the opening 12, which now represents the inlet port, and to exit through opening 11, which now represents the outlet port, whereby the auxiliary connection lines 6, 7 are interconnected as indicated symbolically by the arrows. The opening 11 is hereby connected by the reversing valve 8 via the auxiliary connection line 9 for venting. Suitably, the reversing valve 8 is so configured that a connection for venting the opening 11 is accompanied by a switchover of the auxiliary connection lines 6, 7 to the first operative state.

Figure 5B:
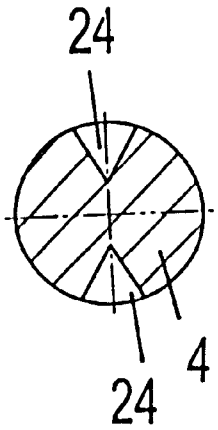
FIG. 5*b* is a cross sectional view of the control element, taken along the line V—V in FIG. 5*a*.
Figure 5A:
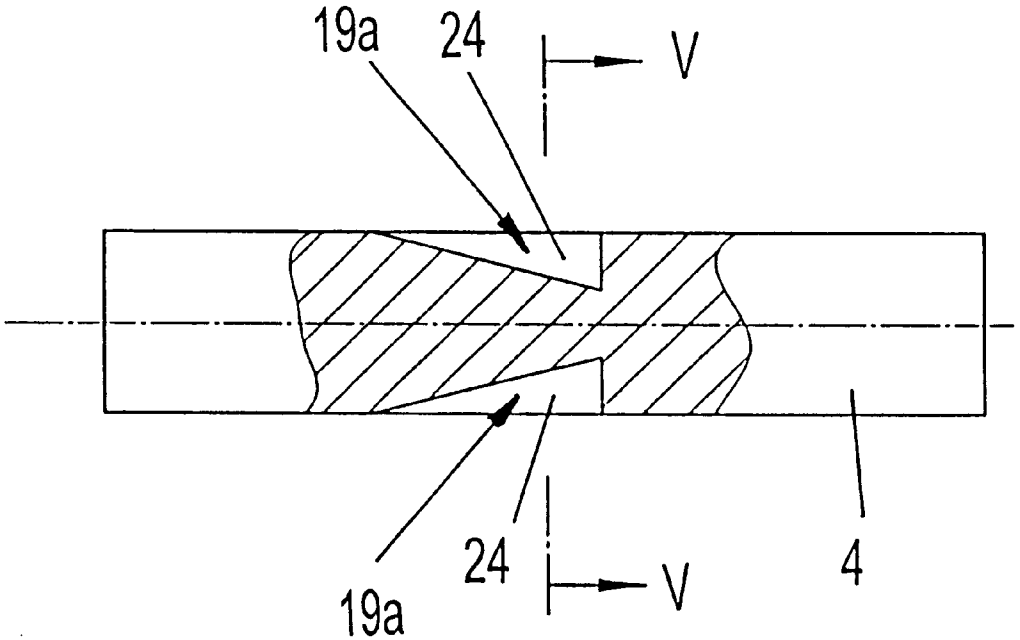
FIG. 5*a* is a detailed longitudinal section of a modification of a control element.

Referring now to FIGS. 5*a* and 5*b*, there are shown longitudinal and cross sectional views of a variation of the piston-shaped control element 4 in which the control opening 19*a* is defined by two V-shaped grooves 24 formed longitudinally in the outer surface area of the control element 4. Of course the number of V-shaped grooves 24 is only exemplary as any number of such grooves may be provided. Each V-shaped groove 24 has a depth configuration which progressively increases linearly in the direction toward the right end position (stop 18), with the V-shaped groove 24 bounded by side surfaces in the form of a rectangular triangle.

While the invention has been illustrated and described as embodied in a pneumatic valve, it is not intended to be limited to the details shown since various modifications and structural changes may be made without departing in any way from the spirit of the present invention.

What is claimed as new and desired to be protected by Letters Patent is set forth in the appended claims:

What is claimed is:

1. A pneumatic valve for controlling a volume flow of an operating gas supplied from a gas supply under pressure, comprising:

a valve body having first and second ports for entry and exit of the operating gas, a main connection line provided for linking the ports and including two parallel ring channels separated by a ridge, and a cross bore extending across the valve body and intersecting the main connection line;

an adjustable throttle including a control element defined by an axis and having an outer surface area, said control element being received in the cross bore for movement between first and second end positions and having a control opening provided for connection of the ring channels and configured in the form of V-shaped grooves which extend outwards to the outer surface area of the control element and have a first groove portion which tapers gradually in direction of the axis of the control element and a second portion which extends transversely to the axis to thereby define for the operating gas an effective area which is bounded in radial direction by the ridge and a circumferential surface area of the control opening of the control element and progressively decreases as the control element moves from the first end position toward the second end position, said throttle further including a counterforce member opposing a movement of the control element toward the second end position; and a flow orifice disposed in the main connection line, wherein the throttle and the orifice are disposed in series in the main connection line, and wherein, as viewed in movement direction, the control element is acted upon on a side confronting the first end position by gas pressure commensurate with a gas pressure upstream of the orifice, and acted upon on a side confronting the second end position by gas pressure commensurate with a gas pressure downstream of the orifice, for controlling the effective area of the control opening in dependence on a difference between the gas pressures upstream and downstream of the orifice.

2. The pneumatic valve of claim 1, wherein the cross bore is a cylindrical throughbore, and the control element is a control piston made of plastic and having a cylindrical configuration that complements the cylindrical configuration of the throughbore.

3. The pneumatic valve of claim 2, wherein the control piston is slideably received in substantially frictionless manner in the throughbore.

4. The pneumatic valve of claim 1, wherein the control element is shifted by the counterforce member to a position which is commensurate with the first end position, when no gas pressure acts upon the control element.

5. The pneumatic valve of claim 1, wherein the counterforce member includes an elastic element.

6. The pneumatic valve of claim 5, wherein the elastic element is a helical spring.

7. The pneumatic valve of claim 4, wherein the control element reaches the first end position, when the gas pressure differential is zero, whereby the control opening has a maximum effective area.

8. The pneumatic valve of claim 1, wherein each of the V-shaped grooves has side surfaces defining a triangle.

9. The pneumatic valve of claim 1, and further comprising an adjustment cylinder having a conically tapered end portion for projection through the orifice for adjusting an effective orifice area.

10. The pneumatic valve of claim 1, wherein the control element is connected on the side confronting the first end position by a first auxiliary connection line with a portion of the main connection line, disposed directly upstream of the orifice, and connected on the side confronting the second end position by a second auxiliary connection line with a portion of the main connection line, disposed directly downstream of the orifice.

11. The pneumatic valve of claim 10, and further comprising a reversing valve for switching connections of the first and second auxiliary connection lines such that the first auxiliary connection line is connected with the portion of the main connection line, disposed directly downstream of the orifice, and the second auxiliary connection line is connected with the portion of the main connection line, disposed directly upstream of the flow orifice, wherein the one of the first and second ports intended for outgoing operating gas is disconnected by the reversing valve from the gas supply and connected for venting.

12. The pneumatic valve of claim 11, wherein the reversing valve is so operated as to switch over the first and second auxiliary connection lines, when the one port is connected for venting.

13. A pneumatic valve for maintaining a substantially constant volume flow of an operating gas, comprising:

a valve body having two ports, and a main passageway provided for conduction of an operating gas between the ports and including two ring channels which are separated by a ridge;

a throttle biased by a force to seek a first end position and having a throttle opening which intersects the main passageway and is formed by V-shaped grooves which extend outwards to an outer surface area of the control element and have a first groove portion which tapers gradually in axial direction of the throttle and a second portion which extends transversely to the axial direction to thereby define an effective area which is bounded in radial direction by the ridge and the throttle and progressively decreases as the throttle moves from the first end position toward a second end position for controlling a flow of gas through the main passageway; and an orifice disposed in the passageway in series with the throttle, wherein the valve body has a first passage for fluidly connecting an area on one side of the throttle with an area at one side of the orifice, and a second passage for fluidly connecting an area on another side of the throttle with an area at another side of the orifice, thereby controlling the movement of the throttle in dependence on a difference between gas pressures on opposite sides of the orifice.

14. The pneumatic valve of claim 13, wherein the valve body has a throughbore, wherein the throttle includes a control piston made of plastic and having a configuration complementing a configuration of the throughbore so as to be slideably received in substantially frictionless manner in the throughbore.

15. The pneumatic valve of claim 13, wherein the force biasing the throttle is implemented by a helical spring by which the throttle is moved to the first end position, when no gas pressure acts upon the throttle.

16. The pneumatic valve of claim 15, wherein the throttle reaches the first end position, when the gas pressure differential is zero, whereby the throttle opening has a maximum effective area.

17. The pneumatic valve of claim 13, wherein the two parallel ring channels are connectable by the throttle opening.

18. The pneumatic valve of claim 13, wherein each of the V-shaped grooves has side surfaces defining a triangle.

19. The pneumatic valve of claim 13, and further comprising an adjustment cylinder having a conically tapered end portion for projection through the orifice for adjusting an effective orifice area.

20. The pneumatic valve of claim 13, and further comprising a reversing valve for so interconnecting the first and second passages that in another operative state the area on the one side of the throttle is fluidly connected with the area at the other side of the orifice, and the area on the other side of the throttle is fluidly connected with the area at the one side of the orifice, wherein the one port intended for outgoing operating gas is disconnected by the reversing valve from a gas supply and connected for venting.

21. The pneumatic valve of claim 20, wherein the reversing valve is so operated as to reverse connection of the first and second passages, when the one port is connected for venting.

* * * * *